US009789989B2

(12) United States Patent
Kuehl et al.

(10) Patent No.: US 9,789,989 B2
(45) Date of Patent: Oct. 17, 2017

(54) FLEXIBLE LOOP APPLICATOR AND METHOD

(71) Applicant: Northfield Corporation, DePere, WI (US)

(72) Inventors: Craig Kuehl, DePere, WI (US); Rob W. Lindquist, DePere, WI (US); Michael G. Boehm, DePere, WI (US)

(73) Assignee: Northfield Corporation, DePere, WI (US)

( * ) Notice: Subject to any disclaimer, the term of this patent is extended or adjusted under 35 U.S.C. 154(b) by 675 days.

(21) Appl. No.: 14/265,911

(22) Filed: Apr. 30, 2014

(65) Prior Publication Data

US 2014/0331604 A1 Nov. 13, 2014

Related U.S. Application Data

(60) Provisional application No. 61/818,060, filed on May 1, 2013.

(51) Int. Cl.

| | |
|---|---|
| ***B65B 61/20*** | (2006.01) |
| ***B65C 7/00*** | (2006.01) |
| ***B65C 3/18*** | (2006.01) |
| ***B65C 9/18*** | (2006.01) |
| ***G09F 3/04*** | (2006.01) |
| ***G09F 3/14*** | (2006.01) |

(52) U.S. Cl.

CPC ..... *B65B 61/202* (2013.01); *B65C 3/18* (2013.01); *B65C 7/00* (2013.01); *G09F 3/04* (2013.01); *G09F 3/14* (2013.01)

(58) Field of Classification Search

CPC B65C 7/00; B65C 3/18; B65B 61/202; B65B 13/022; G09F 3/14

USPC ..... 40/665; 53/410, 414, 128.1, 139.4; 100/9

See application file for complete search history.

(56) References Cited

U.S. PATENT DOCUMENTS

| | | | | |
|---|---|---|---|---|
| 2,236,936 A * | 4/1941 | Camp | A47F 13/08 | 100/9 |
| 2,669,047 A * | 2/1954 | Rieger | G09F 3/14 | 40/637 |
| 3,186,333 A * | 6/1965 | Hoffman | B65B 13/022 | 100/9 |
| 4,236,305 A * | 12/1980 | Hetherington | A47J 45/065 | 215/399 |
| 4,261,089 A * | 4/1981 | Taylor | B25B 27/0028 | 29/235 |

(Continued)

*Primary Examiner* — Andrew M Tecco
*Assistant Examiner* — Praachi M Pathak
(74) *Attorney, Agent, or Firm* — Nicholas A. Kees; Godfrey & Kahn, S.C.

(57) ABSTRACT

A tag applicator, and a method, for applying a tag, having an elastic loop, to a product. The tag applicator includes a linear actuator, and a pair of tag arms, one end of each being pivotably connected to the linear actuator. The two arms are biased toward each other, such as by a spring. A separator is positioned between the tag arms, so as to force the tag arms to separate as the linear actuator extends. A finger or tag hook is connected at the end of each tag arm, configured and positioned to connect to or insert into the elastic loop, and to extend the elastic loop as the tag arms are separated. With the tag loop held open, the product moves into the loop, and the tag is thereby applied to the product.

8 Claims, 14 Drawing Sheets

(56) References Cited

U.S. PATENT DOCUMENTS

| | | | | | |
|---|---|---|---|---|---|
| 4,401,020 | A * | 8/1983 | Brux | B65B 13/022 | 100/6 |
| 4,470,241 | A * | 9/1984 | Parry | B65B 13/022 | 100/6 |
| 4,847,130 | A * | 7/1989 | Cooper | B65C 3/18 | 156/249 |
| 5,014,407 | A * | 5/1991 | Boughten | B25B 7/02 | 29/235 |
| 5,241,743 | A * | 9/1993 | Hubbs | B65B 61/202 | 29/450 |
| 5,275,681 | A * | 1/1994 | Hettler | B31D 1/023 | 156/249 |
| 5,768,767 | A * | 6/1998 | Burchell | B23P 19/04 | 29/235 |
| 5,953,887 | A * | 9/1999 | Lucas | A01G 9/08 | 53/247 |
| 7,160,412 | B2 * | 1/2007 | Baumli | B65C 7/00 | 156/256 |
| 7,565,789 | B2 * | 7/2009 | Lucas | B65B 13/022 | 100/9 |
| 8,458,874 | B2 * | 6/2013 | Ziegler | B65H 19/10 | 156/215 |
| 2005/0166439 | A1 * | 8/2005 | Ludlow | G09F 3/14 | 40/665 |
| 2009/0188144 | A1 * | 7/2009 | Ludlow | G09F 3/04 | 40/665 |
| 2013/0239449 | A1 * | 9/2013 | Heinrichs | G09F 3/0288 | 40/665 |

* cited by examiner

FLEXIBLE LOOP APPLICATOR AND METHOD

CROSS REFERENCE TO RELATED APPLICATION

This application claims priority to U.S. Provisional Patent Application Ser. No. 61/818,060, filed May 1, 2013.

BACKGROUND

The present invention relates generally to devices and methods of operation of devices for separating items having flexible loops, which may include attached tags, and applying those loops to a product or packaging.

Often during the production and packaging of a product along a production line, it is desired to place some small item, such as a coupon or other relatively small object, onto the packaging of the product, or onto the product directly. Particularly where the production line for these products moves at fairly rapid pace, it may be difficult or very labor intensive to place the correct number and type of item(s) onto the packages.

Conventional devices for applying items to products or to packaging may draw the items from a large roll or other bulk package. The items to be applied may be formed into a continuous roll or stream, connected together by means of a breakable web between the items. The continuous roll or stream may permit more efficient loading and operation of the items to be applied. As part of the application process, the device may engage the roll or stream, separate the endmost of the items from the roll or stream and apply that item onto the package. To facilitate this separation, the breakable web may include perforations, thinned sections, or other weakened portions.

One particular type of such item 10 is shown in FIG. 1. For example, the ElastiTag product available from Bedford Industries of Worthington, Minn., is such an item 10 comprised of a tag 12 connected to a tag loop 14 made of flexible material such as but not limited to latex. In one manner in which the ElastiTag is available, the tags 12 are arranged in a bandolier arrangement 16, with weakened areas 18, such as perforations, between the tags. That is, the bandolier arrangement 16 includes perforated or otherwise weakened connections to the tag preceding, and the tag following, any particular tag 12. And for each tag 12, a respective tag loop 14 is relatively permanently connected to each respective one of the tags. The tag loops 14 may also be connected sequentially to each other, that is, although not required, each particular tag loop may be removably connected to the tag loop preceding and the tag loop following that particular tag loop.

Shown in FIG. 2 is an item of packaging or an actual product 20, to which the item 10 has been applied. Generally items such as item 10 are applied to products 20 manually, by a human operator, with the attendant issues of throughput and accuracy.

Improvements to conventional separation and application devices and methods of operating these devices are desired.

SUMMARY OF THE INVENTION

The invention provides a tag applicator for applying a tag, having an elastic loop, to a product. According to the invention, the tag applicator includes a linear actuator, and a pair of tag arms, one end of each being pivotably connected to the linear actuator. The two arms are biased toward each other, such as by a spring. A separator is positioned between the tag arms, so as to force the tag arms to separate as the linear actuator extends. A finger or tag hook is connected to each tag arm, configured and positioned to connect to the elastic loop, and to extend the elastic loop as the tag arms are separated. The separator may be formed of a pair of separator rollers, each bearing on a bearing surface of a respective tag arm.

The invention also provides a method of applying a tag, from a bandolier of tags, to a product, each tag having an elastic loop. The method includes inserting a pair of tag hooks, each positioned at the end of a respective arm, into the elastic loop by extending a linear actuator connected to both arms. The tag hooks are separated from one another by further extending the linear actuator such that the arms are separated by a separator, thereby holding the loop in an open position. The tag is then separated from the bandolier of tags, the product is permitted to move into an open portion of the loop and, with the product at least partially in the loop, the tag is released and permitted to stay on the product. Alternatively, with the product at least partially in the loop, the movement of the product alone may pull the loop and the tag so that the tag stays on the product.

Other objects and advantages of the invention will become apparent hereinafter.

BRIEF DESCRIPTION OF THE DRAWING FIGURES

FIGS. 12A-12F are enlarged views of a portion of the apparatus shown in FIG. 3, each showing a portion of the sequence of operation of the apparatus.

DETAILED DESCRIPTION

Figure 1:
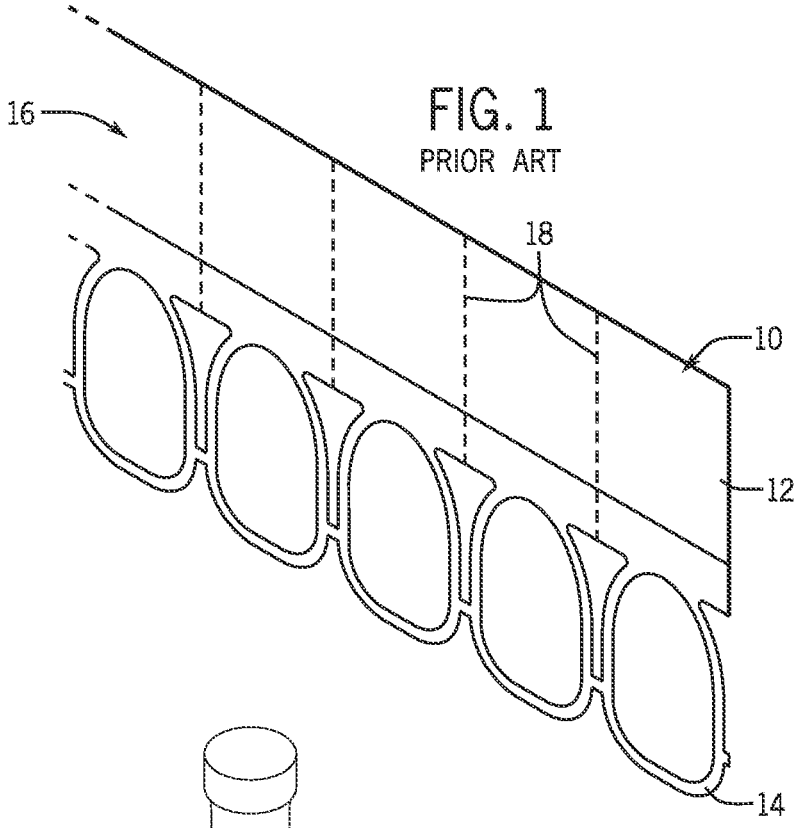
FIG. 1 PRIOR ART
FIG. 1 is an isometric view of a stream of items to be applied to products.
Figure 2:
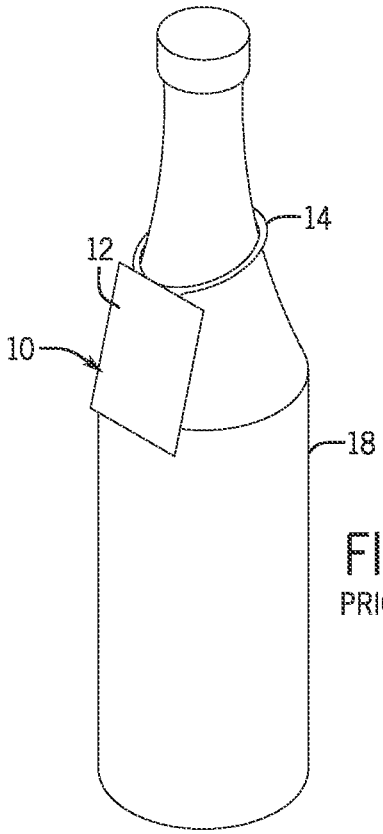
FIG. 2 PRIOR ART
FIG. 2 is an isometric view of a product to which one of the items has been applied.
Figure 3:
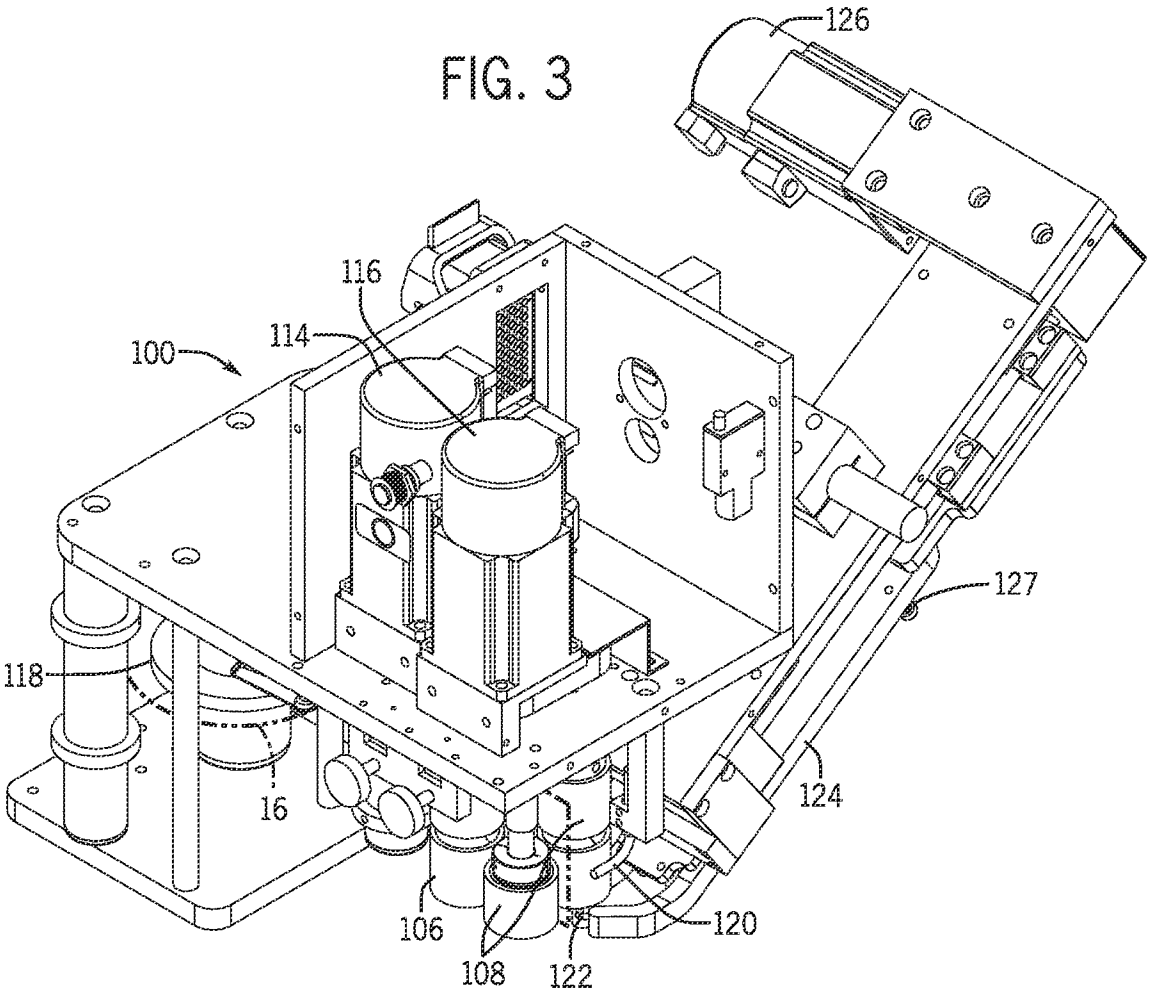
FIG. 3 is an isometric view, from an upper angle, of an apparatus constructed according to a preferred embodiment of the invention, for applying the items to the products.

The present invention relates to an apparatus for placing items onto products on a production line. In FIGS. 3-12 is illustrated an applicator 100 constructed according to the invention. In a typical installation, applicator 100 would be mounted adjacent a production line on which are moving items onto which the application of an appropriate object is desired.

The applicator 100 includes a set of infeed rollers 106 and a set of outfeed rollers 108, which cooperate to define a path through applicator 100 for the tags being handled by the applicator. Infeed rollers 106 pull the tags 12 into the applicator 100 and cooperate with the outfeed rollers 108 to position the tag loops 14 for application to the products 20 to be tagged. The infeed rollers 106 and the outfeed rollers 108 are rotated by a set of rotary actuators 114 and 116 respectively, such as servo motors, stepper motors, or other devices for providing controlled rotary motion, operating directly connected to at least one of each pair, infeed rollers and outfeed rollers, or operating them remotely by means of gears, belts, or other suitable connections. The infeed rollers 116 and outfeed rollers 118 cooperate to separate each leading tag 12 from the following tag 12 in the bandolier 16. Various apparatus for feeding and separating perforated items are shown in U.S. Pat. Nos. 5,845,462, 5,966,906, 6,082,079, 7,032,774 and 7,540,125, the disclosure of which patents are incorporated herein by reference in their entirety for all purposes.

Figure 9:
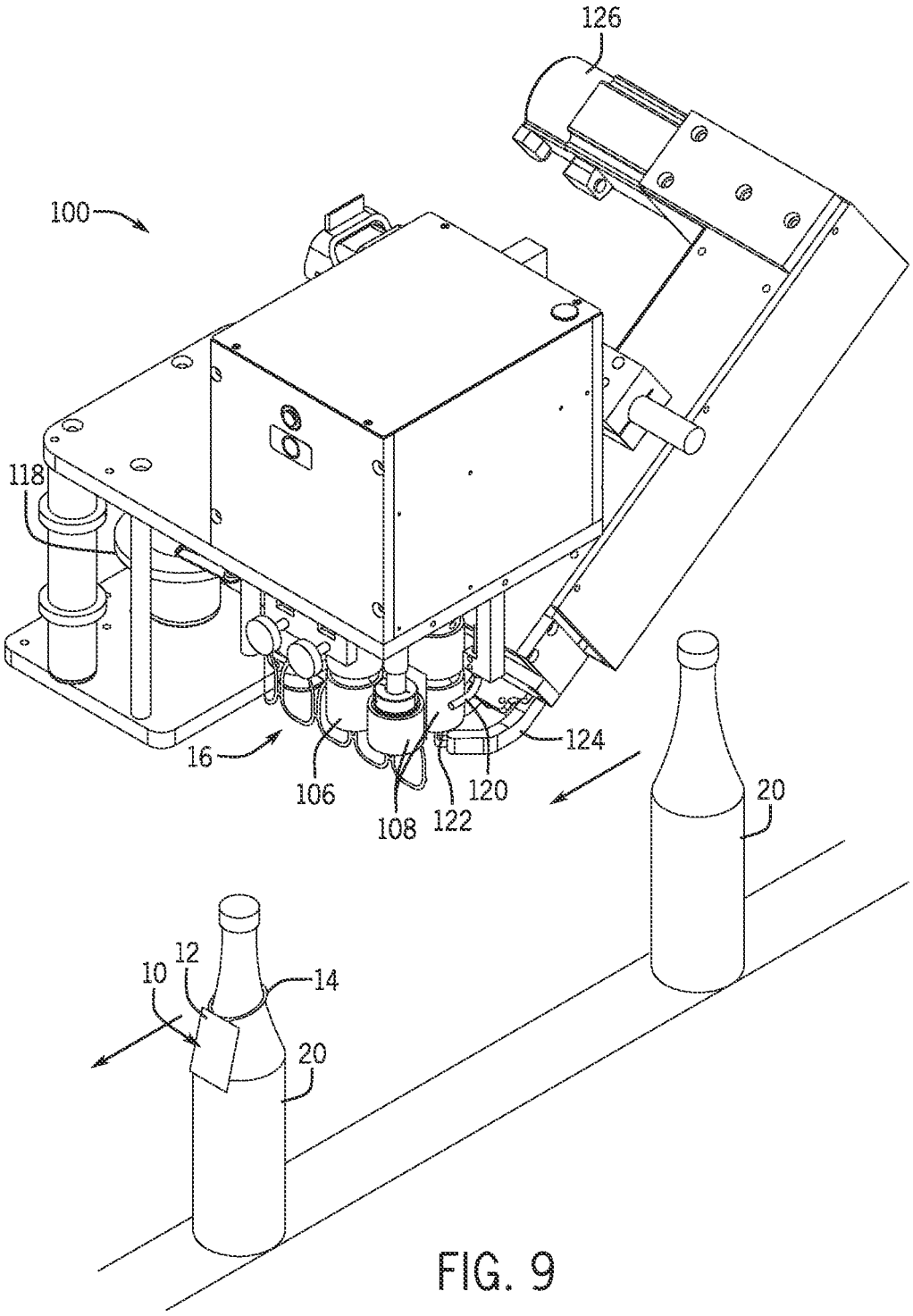
FIGS. 9, 10 and 11 are isometric views of the apparatus shown in FIG. 3, in proximity to a conveyor of products, each showing a portion of the sequence of operation of the apparatus.

Upon power up, the rotary actuators 116 engage, and the tags 12, already having been loaded onto an unwind mandrel 118 (FIGS. 7-8), are fed into the infeed rollers 106 and the outfeed rollers 108. As a part of the startup routine, the leading tag 12 of the bandolier 16 is brought forward by infeed rollers 106 and outfeed rollers 108 running at the same speed until a tag sensor 120 senses the leading edge of the tag. In some instances, the tags 12 are supplied with registration marks or "cue" marks (not shown). When this is the case, the system can sense the tag 12 prior to the in-feed rollers 106 if desired. When the tag 12 is detected, it continues to travel an adjustable distance called the tag offset. When the tag offset distance is reached, the outfeed rollers 108 stop and hold the tag 12 in the outfeed rollers, in a ready position, with the respective tag loop 14 of that particular tag hanging downward as shown in FIG. 9.

According to the embodiment shown, the applicator 100 further includes a pair of fingers 122, mounted to the distal end of two arms 124, one such finger to each of the two arms. The opposite end of each arm 124 is connected to a linear actuator 126. Linear actuator 126 is powered by any suitable medium to induce its motion, including pneumatic power, a servo motor driving a screw or a rack and pinion arrangement, a solenoid, or other motive force, depending on the model of applicator and the required speeds. The arms 124 are rotatably connected to the linear actuator 126, and rotatable outward or apart or away from each other. The arms 124 are biased inward or toward each other, such as by a spring 127 connected between the two arms. The arms 124 are separated by one or more separator rollers 128 and each arm has a cam surface that engages with and rides on the separator roller. The embodiment shown includes two separator rollers 128, but a single separator could also be used if suitably constructed and configured.

Figure 4:
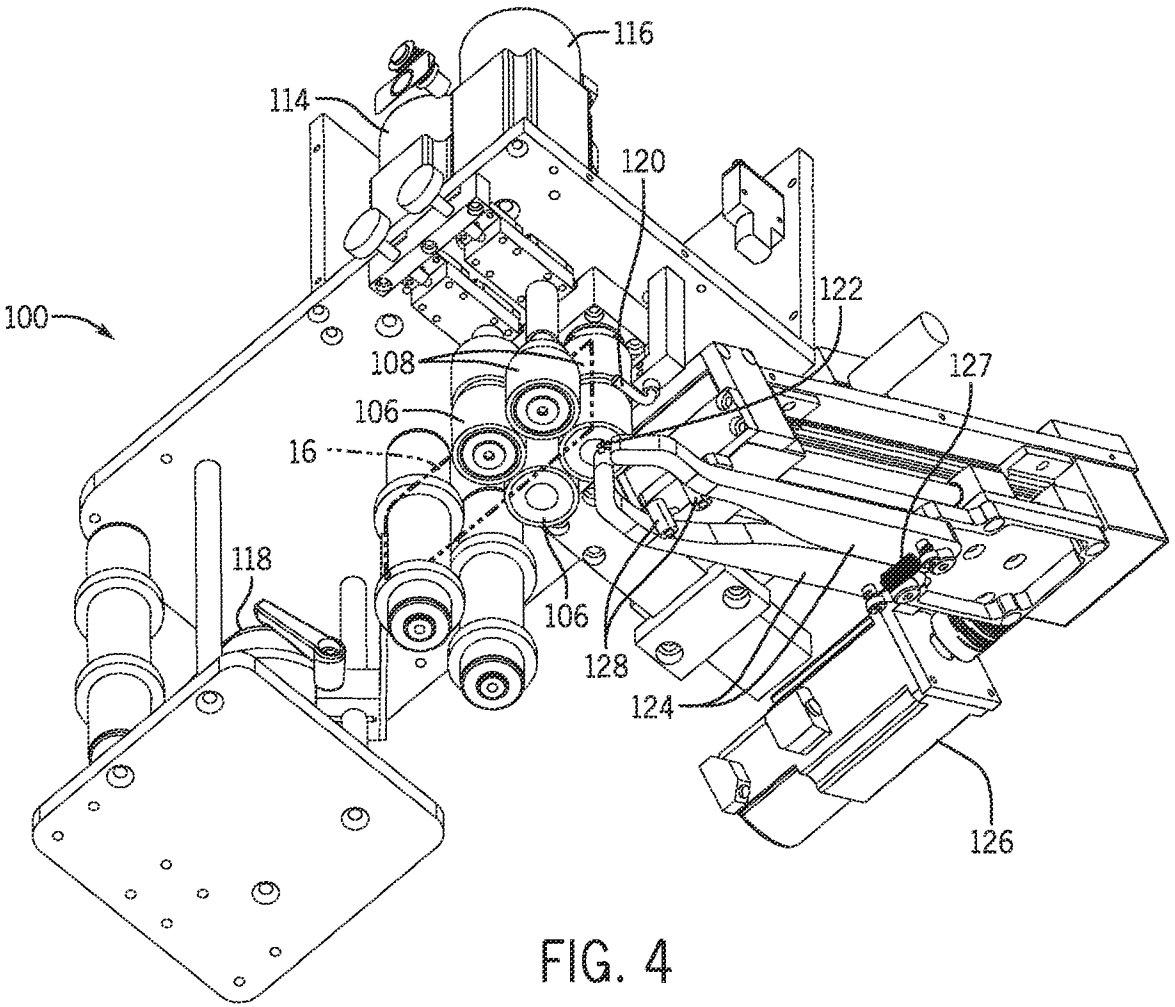
FIG. 4 is an isometric view, from a lower angle, of the apparatus shown in FIG. 3.
Figure 5:
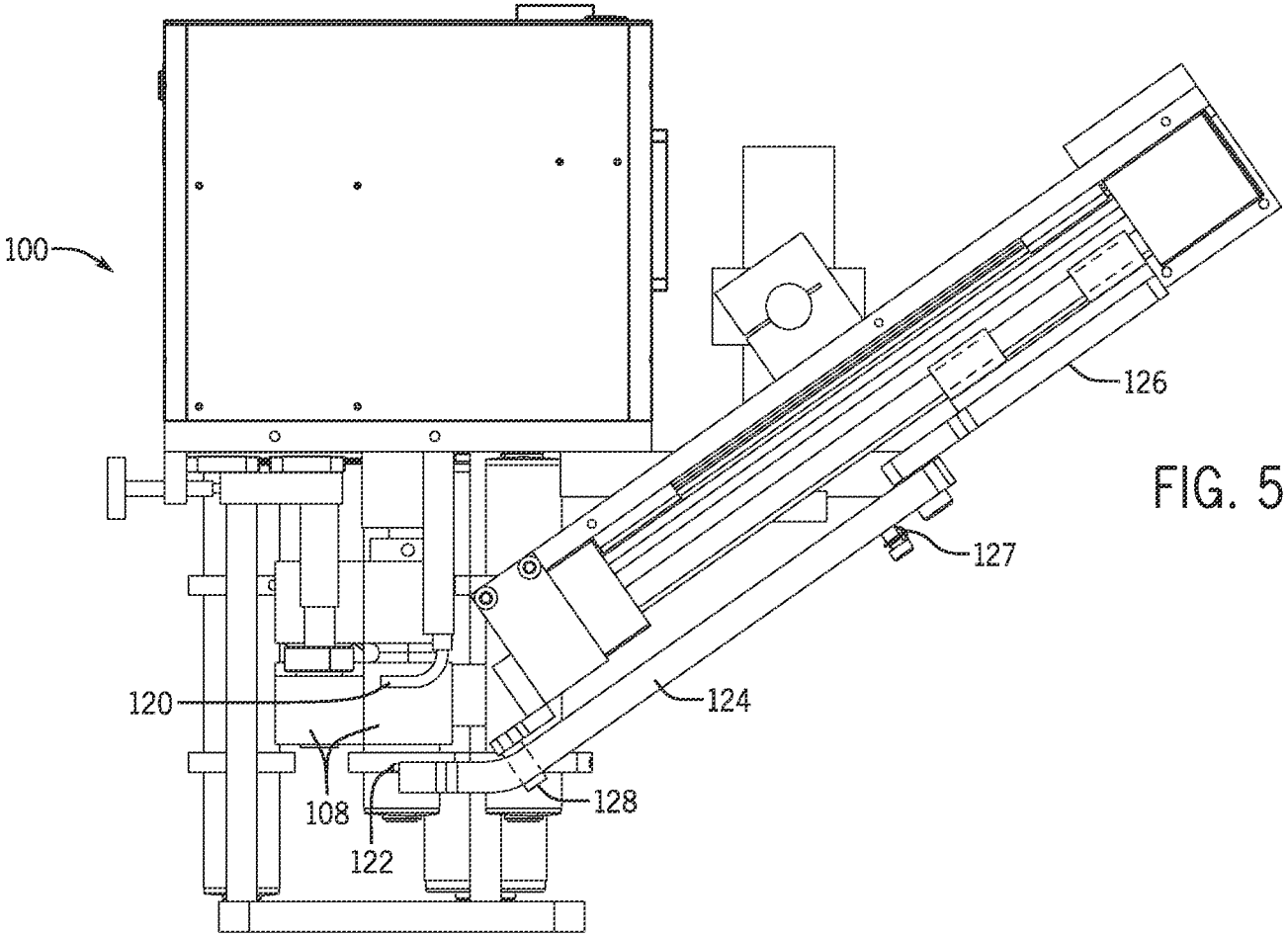
FIG. 5 is a side elevation view of the apparatus shown in FIG. 3, with the arms in a retracted position.
Figure 6:
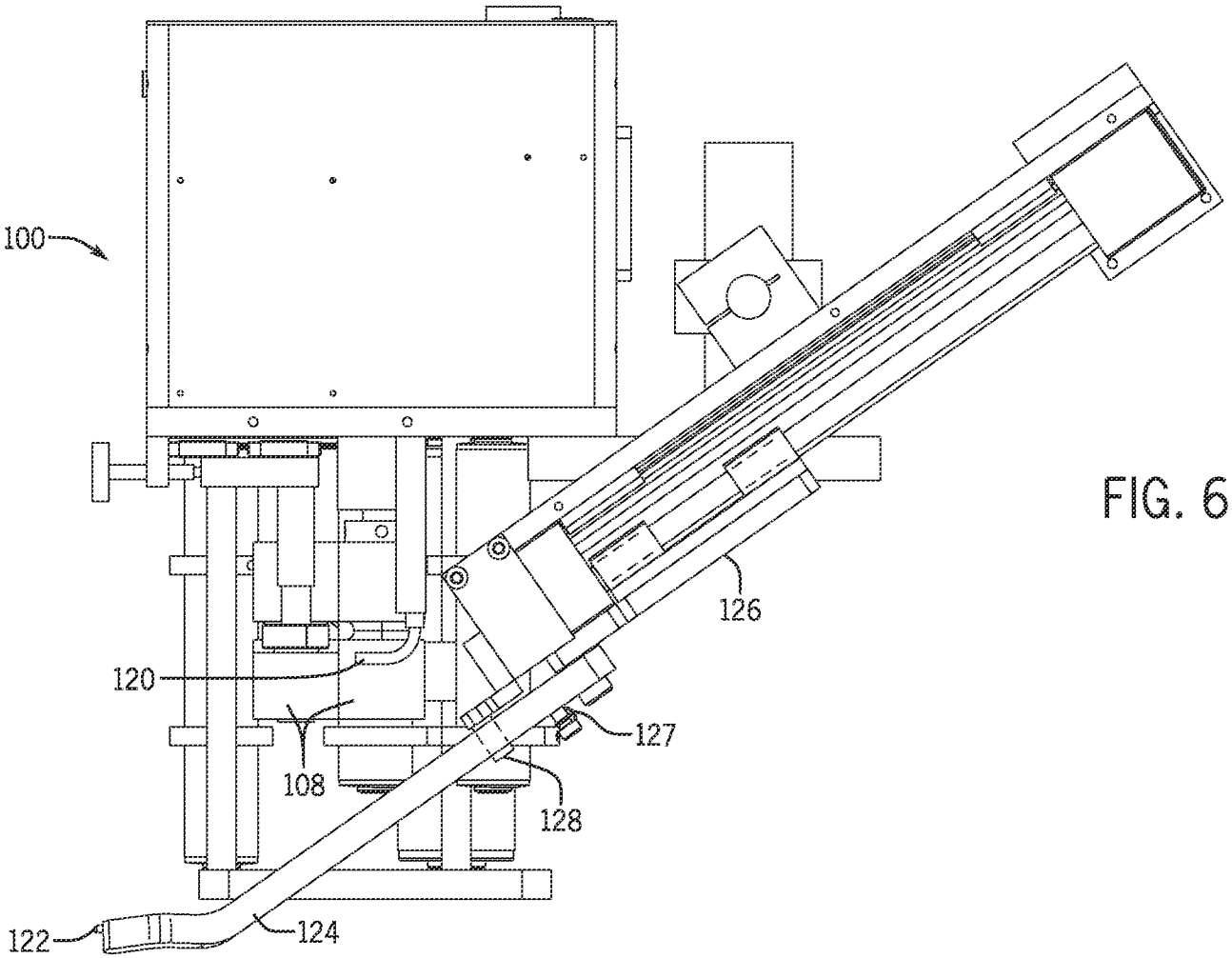
FIG. 6 is a side elevation view of the apparatus shown in FIG. 3, with the arms in an extended position.
Figure 7:
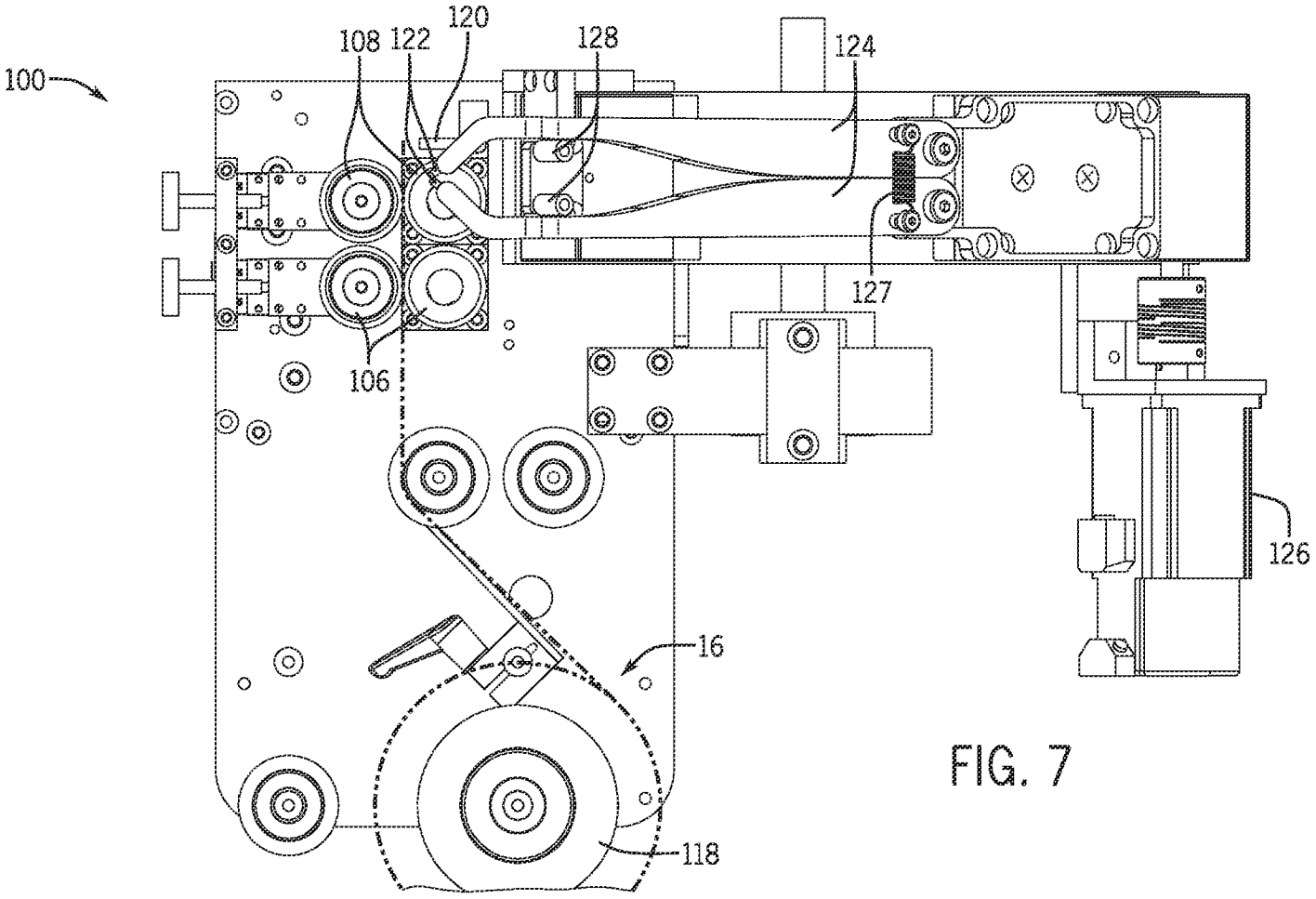
FIG. 7 is a bottom plan view of the apparatus shown in FIG. 3, with the arms in a retracted position.
Figure 8:
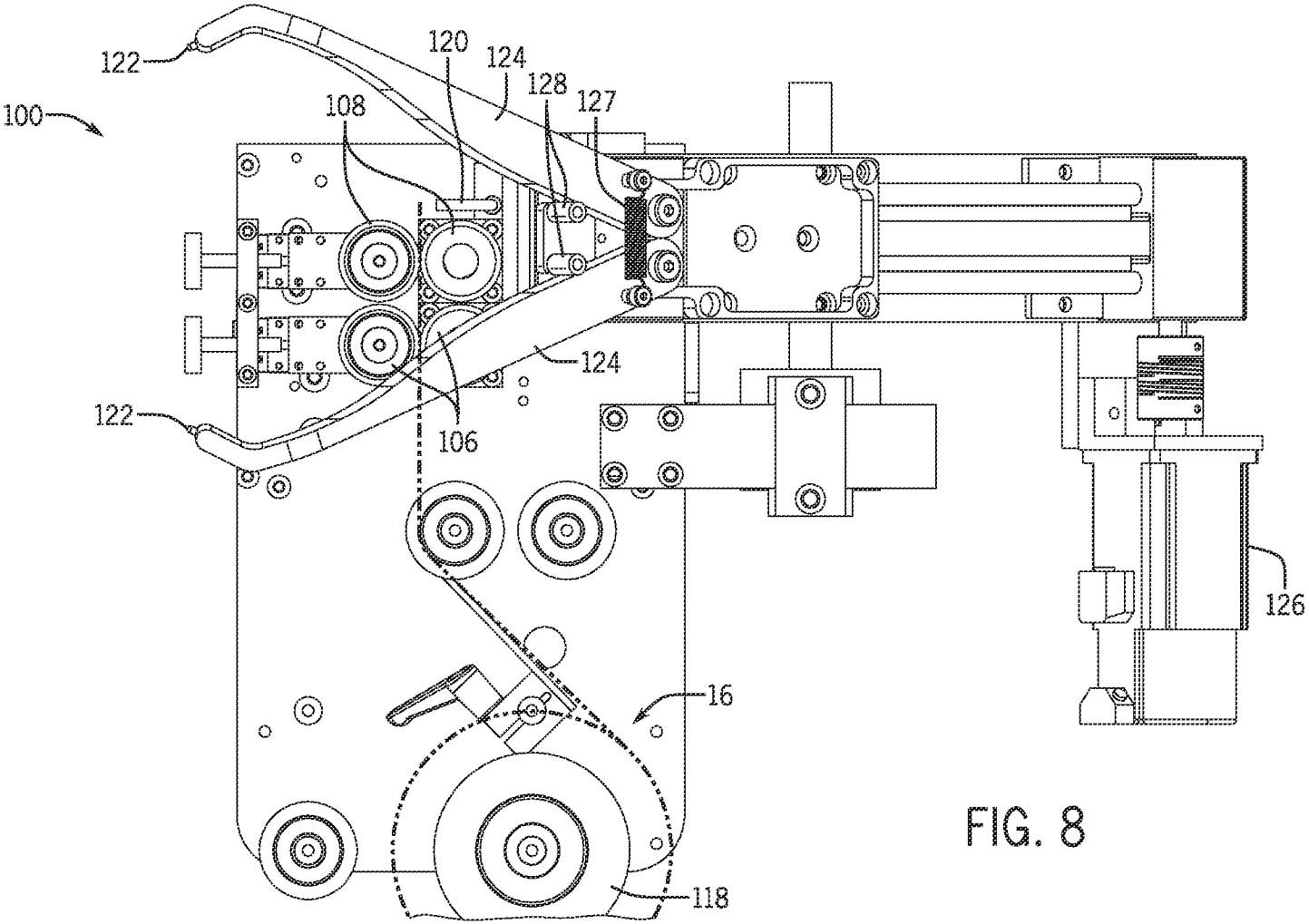
FIG. 8 is a bottom plan view of the apparatus shown in FIG. 3, with the arms in an extended position.
Figure 10:
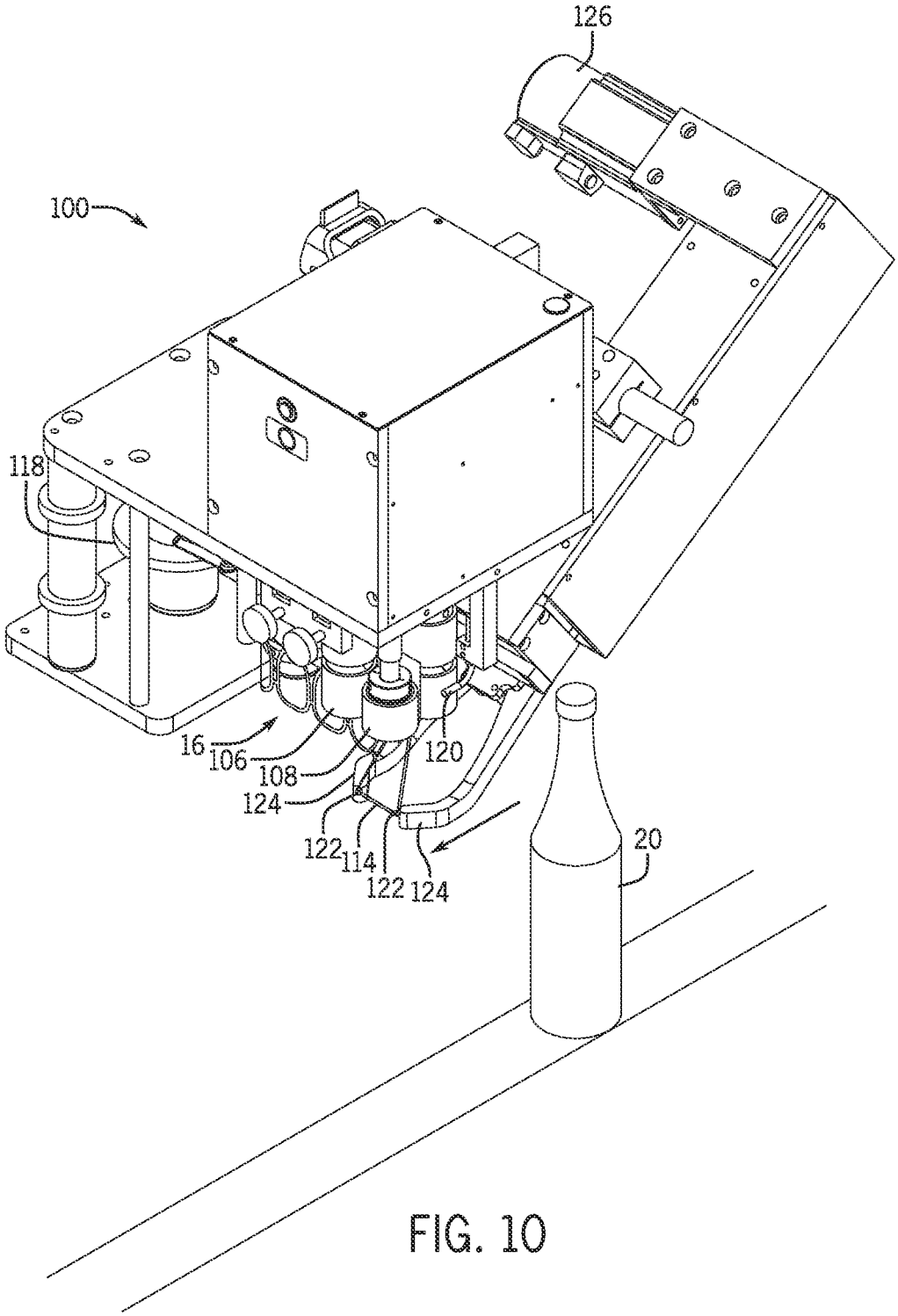
Figure 10E:
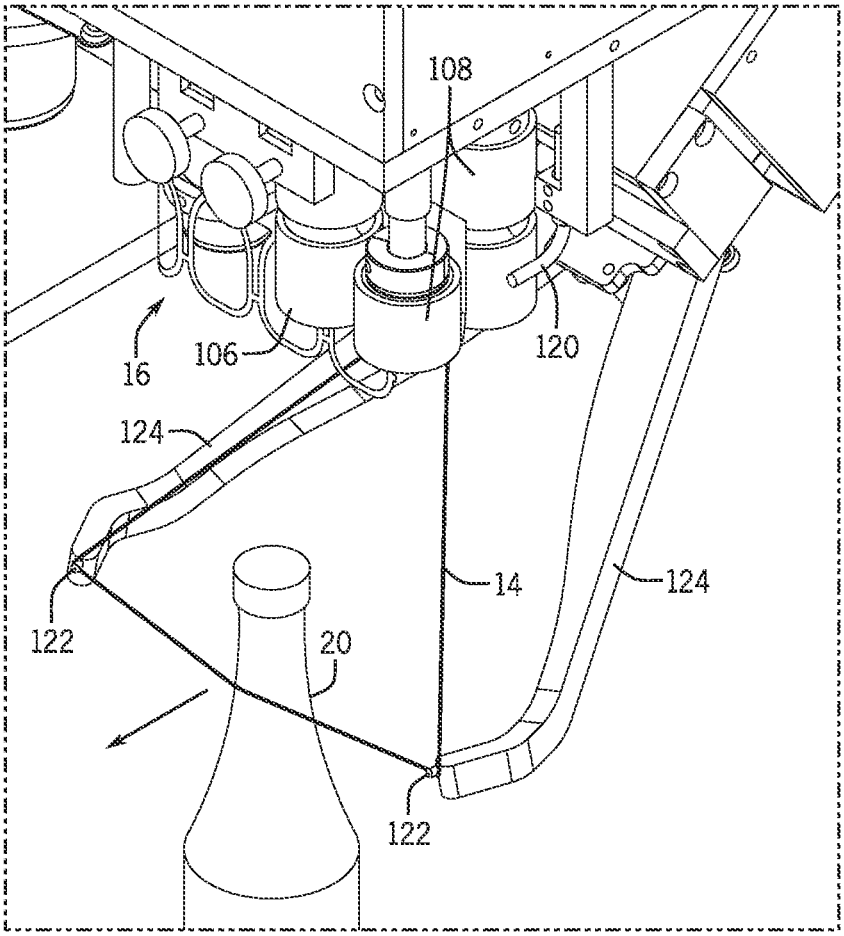
Figure 11:
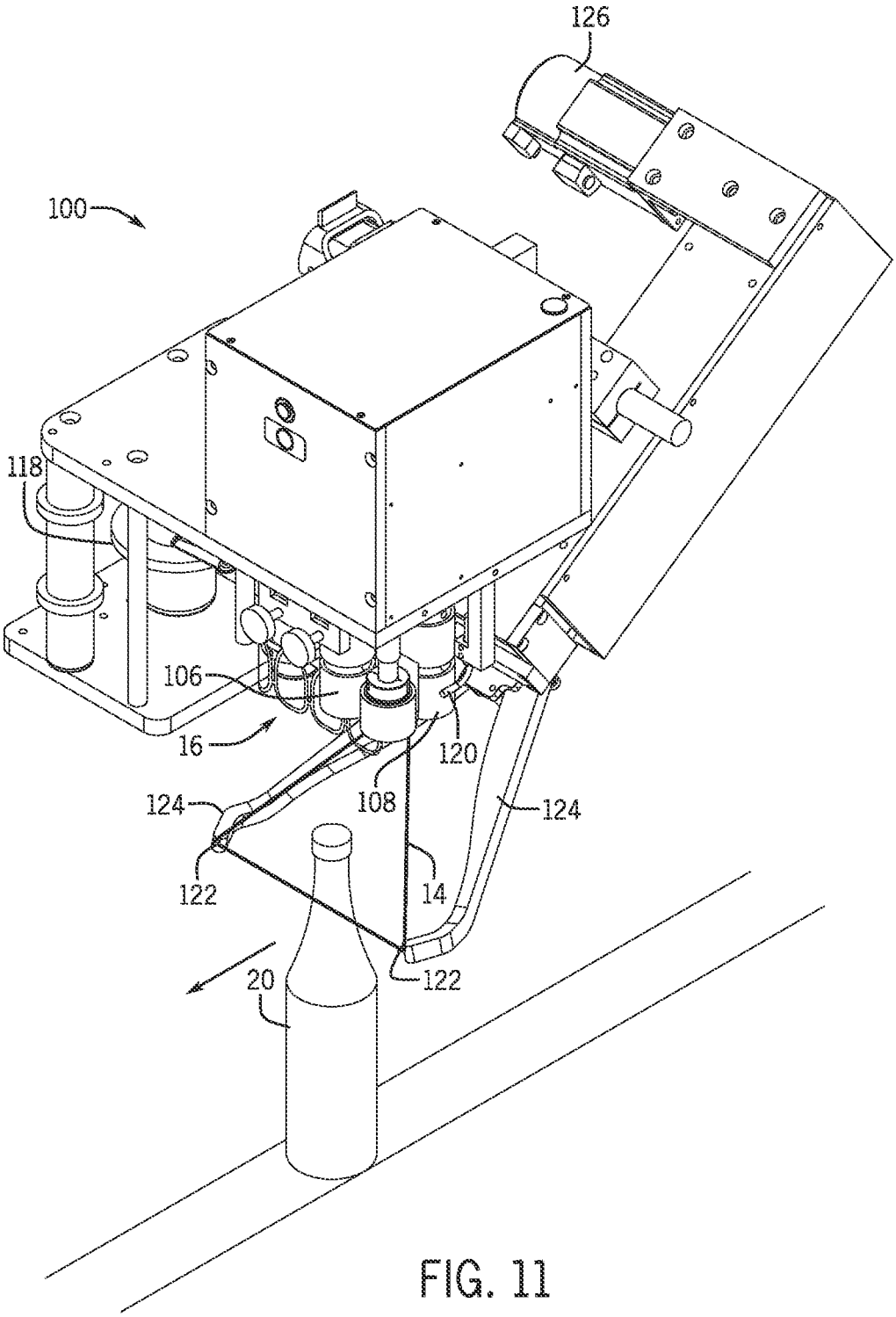
Figure 12A:
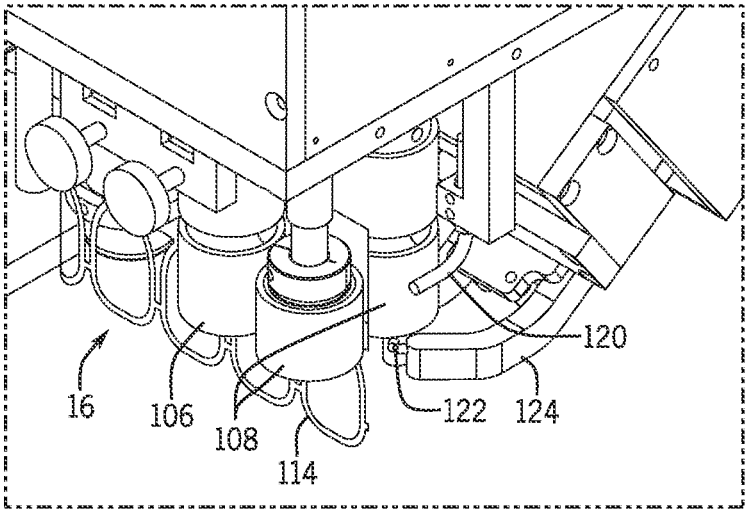
Figure 12B:
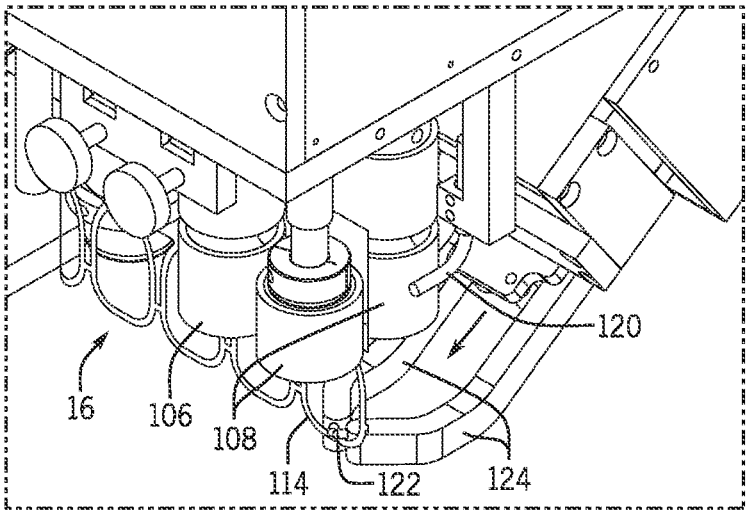
Figure 12C:
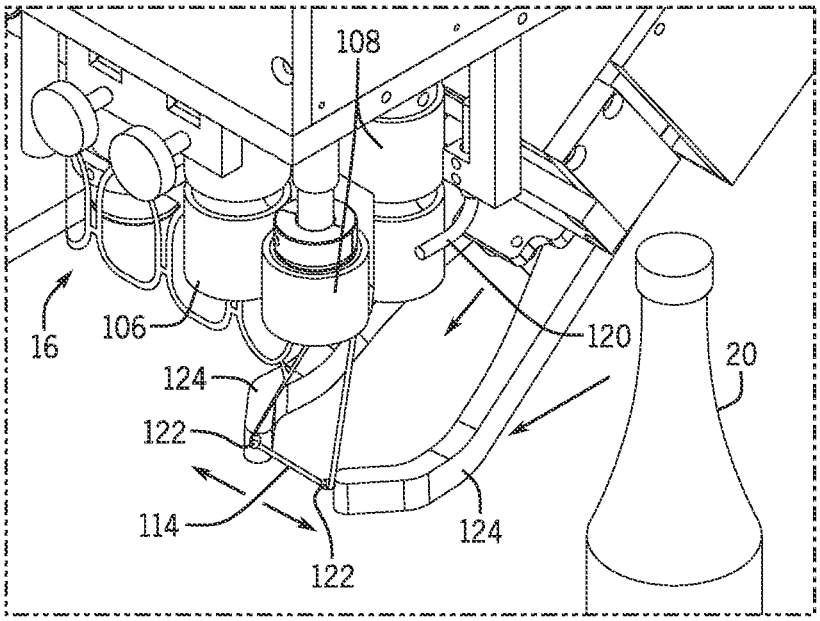
Figure 12D:
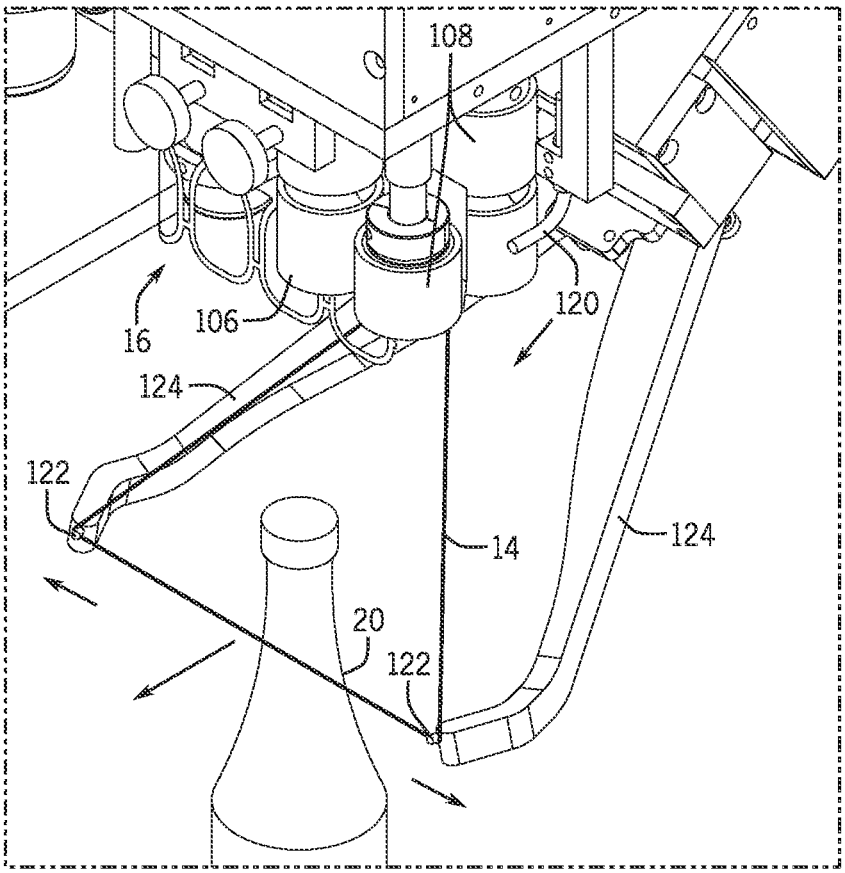

With the linear actuator 126 in its retracted position, as shown in FIGS. 4, 5 and 7, the ends of the arms 124, and the fingers 122 mounted to the distal ends of those arms, are close together, sufficiently close so that both fingers catch in the tag loop 14 hanging down from the tag 12, as shown in FIG. 10 and FIG. 12B. As linear actuator 126 extends the arms 124, the ends of the arms 124 are forced apart by the separator rollers 128. In operation, then, linear actuator 126 extends to a predetermined slide stop distance set in a controller 130 (FIG. 13), causing the arms 124 to extend and widen to separate, in turn causing the fingers 122 to hold the elastic tag loop open, as shown progressively in FIGS. 10 and 11, and also in FIGS. 12C and 12D. While the arms 124 are extending, or at least before the tag 12 needs to be released, the in-feed rollers 106 rotate in reverse for an adjustable set distance, causing the perforation 18 between the individual tags 12 to separate. The tag loop 14 is now extended and widened, waiting for the arrival of the product 20 that will accept the tag as shown in FIGS. 12D and 12E.

When the product 20 is detected by the product sensor 132 (FIG. 13), the outfeed rollers 108 wait for the time set in the product time delay and then continue to feed the separated tag 12 out of the outfeed rollers.

Figure 12F:
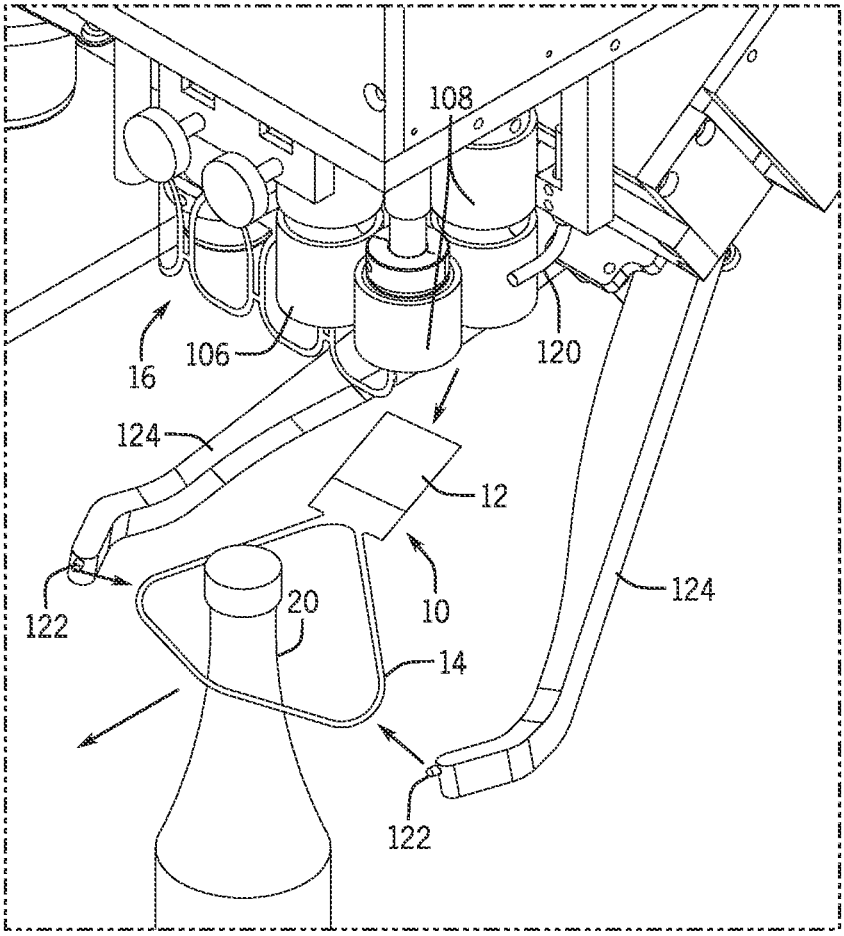

Once the separated tag 12 is released by the outfeed rollers 108, as shown in FIG. 12F, the tag loop 14 is already positioned on the leading edge of the product 20 so that the tag loop 14 is pulled off the fingers 122. The tag loop 14, being elastic, contracts to its original shape and size. It thereby constricts around the product 20, thus attaching itself and the tag 12 to the product.

The linear actuator 126 is then returned to its refracted position as shown in FIGS. 4 and 7. Once the linear actuator 126 is in its home or refracted position, the in-feed rollers 106 and the out-feed rollers 108 may then begin again to advance the next tag 12 and tag loop 14 into position, and the cycle repeats.

Figure 13:
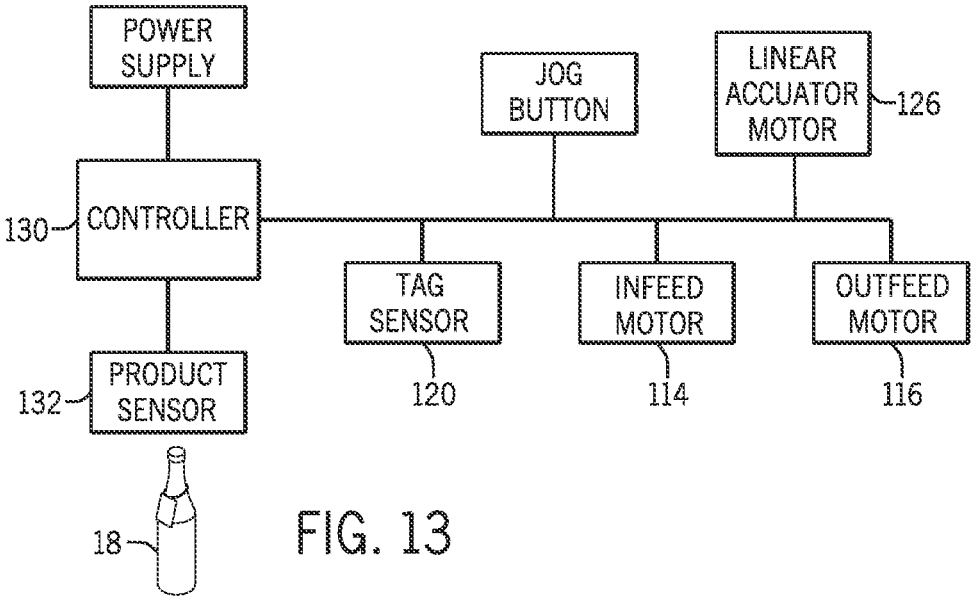
FIG. 13 is a schematic view of the controls for the apparatus.

As indicated above, referring now to FIG. 13, a controller 130 is operatively connected to applicator 100 and may be located directly adjacent the applicator or more be more remotely mounted if necessary or desired. Controller 130 provides the operational instructions to applicator 100 to regulate the nature and speed of operation of the applicator. Various controls, data entry interfaces and displays may be provided on an exterior of or in connection with controller 130. Some or all of these controls, interfaces and displays may be mounted inside a housing of controller 130 if greater protection is desired.

While the invention has been described with reference to preferred embodiments, it is to be understood that the invention is not intended to be limited to the specific embodiments set forth above. Thus, it is recognized that those skilled in the art will appreciate that certain substitutions, alterations, modifications, and omissions may be made without departing from the spirit or intent of the invention. Accordingly, the foregoing description is meant to be exemplary only, the invention is to be taken as including all reasonable equivalents to the subject matter of the invention, and should not limit the scope of the invention.

The invention claimed is:

1. A tag applicator for applying a tag to a product, the tag having an elastic loop connected to a certain point on the tag, the tag applicator comprising:

a linear actuator having a movable portion and a stationary portion;

a pair of tag arms, one end of each being pivotably connected to and moving with the movable portion of the linear actuator;

a single spring biasing the two arms toward each other;

a separator, positioned between the tag arms and which is mounted so as not to be movable with respect to the stationary portion of the linear actuator, so as to force the tag arms to separate as the linear actuator extends; and a finger connected to each tag arm, configured and positioned to connect to the elastic loop, and to extend the elastic loop as the tag arms are separated so as to form the loop into a triangle, with the corners of the triangle being formed by the two fingers and the certain point on the tag, and into which triangle the product is moved in order to apply the tag to the product.

2. A tag applicator as recited in claim 1 wherein the separator has a pair of separator rollers rotatably mounted thereto, each respective separator roller bearing on a respective bearing surface of a respective tag arm.

3. A tag applicator for applying to a product a tag having an elastic loop, from a bandolier of tags each having an elastic loop, the applicator comprising:

a pair of infeed rollers, forming an infeed nip therebetween;

a pair of outfeed rollers, forming an outfeed nip therebetween, and cooperating with the infeed rollers to separate one tag from the bandolier of tags, and position the elastic loop from that now separated tag in a predetermined location;

a linear actuator;

a pair of arms pivotably connected to the linear actuator, and biased toward each other;

a separator, positioned between the arms, so as to force the arms to separate as the linear actuator extends; and a tag hook connected to each arm, configured and positioned to connect to the elastic loop, and to extend the elastic loop as the arms are separated.

4. A tag applicator as recited in claim 3 further comprising a spring connected between the two tag arms to bias the tag arms toward each other.

5. A tag applicator as recited in claim 3 wherein the separator comprises a pair of separator rollers, each bearing on a bearing surface of a respective tag arm.

6. A tag applicator for applying a tag to a product, the tag having an elastic loop connected to a connection point on the tag, the tag applicator comprising:

a linear actuator having a movable portion and a stationary portion, the linear actuator capable of extending the movable portion with respect to the stationary portion;

only two tag arms, one end of each tag arm being pivotably connected to the movable portion of the linear actuator, and the tag arms biased toward each other;

a separator, positioned between the tag arms and which is mounted so as to remain stationary with respect to the stationary portion of the linear actuator as the movable portion extends, the separator thereby forcing the tag arms to separate as the movable portion of the linear actuator extends; and two fingers, one finger connected to each tag arm, the fingers configured and positioned to hook to the elastic loop, and to extend the elastic loop as the tag arms separate.

7. A tag applicator as recited in claim 6 wherein, when the movable portion of the linear actuator is extended, the elastic loop is formed into a triangle, with the corners of the triangle being formed by the two fingers and the connection point on the tag, and into which triangle the product is moved in order to apply the tag to the product.

8. A tag applicator as recited in claim 7 wherein the tag arms are biased toward each other by a single spring connected between the tag arms.

* * * * *